US006341515B2

(12) United States Patent
Huber et al.

(10) Patent No.: US 6,341,515 B2
(45) Date of Patent: Jan. 29, 2002

(54) HIGH-PRESSURE DEFORMATION OF TWO PLATES INTO HOLLOW WORKPIECE

(75) Inventors: Ralf Huber, Darmstadt; Bernd Engel, Burbach; Matthias Prier, Wilnsdorf, all of (DE)

(73) Assignee: Schuler Hydroforming GmbH & Co. KG, Wilnsdorf-Wilden (DE)

( * ) Notice: Subject to any disclaimer, the term of this patent is extended or adjusted under 35 U.S.C. 154(b) by 0 days.

(21) Appl. No.: 09/821,808

(22) Filed: Mar. 29, 2001

(30) Foreign Application Priority Data

Mar. 31, 2000 (DE) ..... 100 16 206

(51) Int. Cl.[7] ..... B21D 26/02
(52) U.S. Cl. ..... 72/60; 29/421.1
(58) Field of Search ..... 72/60, 61, 709; 29/421.1

(56) References Cited

U.S. PATENT DOCUMENTS 4,331,284 A * 5/1982 Schulz et al. ..... 72/60
4,534,196 A * 8/1985 Kiyoto et al. ..... 72/61
5,692,406 A * 12/1997 Yasui ..... 72/60
5,737,954 A * 4/1998 Yasui ..... 72/60

FOREIGN PATENT DOCUMENTS

DE 198 16 566 11/1999

* cited by examiner

*Primary Examiner*—David Jones
(74) *Attorney, Agent, or Firm*—Herbert Dubno; Andrew Wilford

(57) ABSTRACT

An apparatus for forming two plates into a hollow workpiece has a pair of dies having edge regions adapted to be pressed together against outer peripheries of the plates. An outer element in the edge region of one of the dies is adapted to rotate therein about an axis generally parallel to the direction and an inner element set in the outer element is rotatable therein about an axis generally parallel to and offset from the outer-element axis. The inner element is formed offset from its axis with an axially throughgoing feed passage aligned with a feed hole in the plate engaging the one die. A fluid forced under pressure through the passage and hole into a space between the plates deforms the plates away from each other in the direction while displacing the hole perpendicular to the direction with movement of the passage perpendicular to the direction.

8 Claims, 3 Drawing Sheets

HIGH-PRESSURE DEFORMATION OF TWO PLATES INTO HOLLOW WORKPIECE

FIELD OF THE INVENTION

The present invention relates to an apparatus for making a hollow workpiece. More particularly this invention concerns an apparatus for pressurizing a space between two plates to deform them outwardly away from each other into a hollow workpiece.

BACKGROUND OF THE INVENTION

It is known to make a hollow workpiece by welding together the peripheries of two plates and forming one of them adjacent the periphery with a small throughgoing feed hole. The two plates are clamped at their peripheries between edge regions of a pair of die halves forming a cavity conforming to the outside shape of the workpiece to be produced. A fluid under very high pressure is introduced into the space between the plates through the feed hole to push the plates apart against the inside faces of the respective halves of the die cavity, thereby plastically deforming the plates and imparting to them the exact shape of the cavity. The resultant workpiece has an exactly determined outside shape and a smooth interior.

The problem with these systems is that, as the plates are being expanded transversely to their main dimension, they inherently creep somewhat parallel to this main dimension, that is perpendicular to the direction in which the two die halves are pressed together. Thus the feed hole, even when the periphery is solidly clamped, will move somewhat if only because of plastic deformation of the plate it is formed in. The result can be misalignment of the feed hole with the feed passage used to force fluid in between the plates. If the feed hole and/or feed passage are made big enough to accommodate this movement, other problems like leakage are created.

Accordingly German document 198 16 566 of S. Schwarz et al describes a system where the feed passage is provided in a slide that can move somewhat parallel to plates. Thus as the plate periphery creeps inward, the slide can move inward with it to maintain alignment of the feed passage in the slide with the feed hole in the plate.

This system has several disadvantages. It creates a substantial leak problem between the slide and the die parts. The slide must be able to move freely to follow the workpiece creep, but at the high pressures being employed this can be difficult so that the slide will stick and become misaligned. Finally it is necessary to provide a flexible coupling to the movable slide, creating a weak spot in a system employing very high pressure.

OBJECTS OF THE INVENTION

It is therefore an object of the present invention to provide an improved system for making a hollow workpiece from two plates by internal high-pressure deformation.

Another object is the provision of such an improved system for making a hollow workpiece from two plates by internal high-pressure deformation which overcomes the above-given disadvantages, that is which allows the plates to creep in a system that is sure to maintain alignment of the feed passage with the feed hole without leakage.

A further object is to provide such a system where no flexible connection need be made to the movable die part.

SUMMARY OF THE INVENTION

An apparatus for forming two plates into a hollow workpiece has according to the invention a pair of dies together forming a cavity and having edge regions adapted to be pressed together in a direction against outer peripheries of the plates. An outer element in the edge region of one of the dies is adapted to rotate therein about an axis generally parallel to the direction and an inner element set in the outer element is rotatable therein about an axis generally parallel to and offset from the outer-element axis. The inner element is formed offset from the respective inner-element axis with an axially throughgoing feed passage aligned with a feed hole in the plate engaging the one die. A fluid is forced under pressure through the passage and hole into a space between the plates to deform the plates away from each other in the direction while displacing the hole perpendicular to the direction with rotation of the outer element in one sense and rotation of the inner element in an opposite sense for movement of the passage in a straight line perpendicular to the direction.

With this system therefore the two elements rotate in the one die, which can be the upper or lower die, so that sealing between them and between the outer element and the one die is very simple. At the same time the two elements can rotate smoothly so that the passage of the inner die can follow the straight-line movement of the hole in the one plate as same creeps inward during the main deformation phase of the shaping operation.

According to the invention the two elements are disks of substantially circular shape. They have outer peripheries or surfaces that are at least partially frustoconical so that they will not shift substantially parallel to the direction toward the plates no matter how much pressure is employed.

The inner-element disk has a diameter equal to at most half a diameter of the outer-element disk. In addition the inner element has a face engageable with the one plate and formed around the passage with a collar engaging in the hole and fitting the inner element to the hole. This collar can be tapered toward the plates to fit snugly in and form a good seal with the hole of the one plate.

The inner element and the one plate have confronting faces. Another passage formed in the one plate opens at the one-plate face in alignment with the inner-element passage. Furthermore the one-plate face is formed with an enlarged recess into which the one-plate passage opens. The inner-element passage opens into the recess. This recess is circular, generally centered on the outer-element axis, and of a diameter smaller than a diameter of the outer element.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
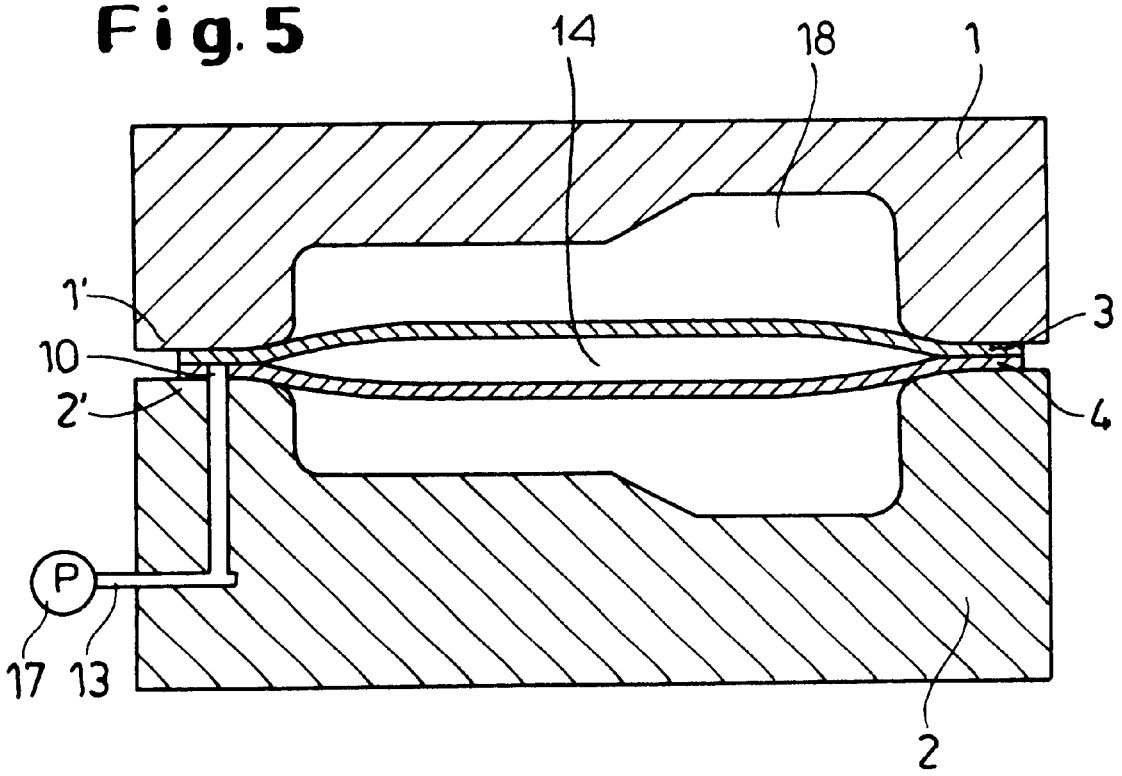
FIG. 5 is a partly diagrammatic smaller-scale section through the apparatus.

As seen in FIG. 5 in order to make a hollow workpiece a pair of die halves 1 and 2 are pressed together as indicated by arrows P so their outer edge regions 1' and 2' bear on the outer peripheries of a pair of plates 1 and 2 with a cavity 18 of the die halves 1 and 2 spacedly surrounding the plates 30 and 4 between the plates 3 and 4. A pump 17 feeds a fluid through a conduit 13 and a hole 10 near the periphery of the plate 4 to a space 14 between the two plates 3 and 4. The pressurized fluid forces the plates 3 and 4 outward into engagement with the inner faces of cavity 18.

As shown in FIGS. 1 through 4, the lower die half 2 is partly formed as a plate 5 in which is set a large outer element or disk 6 centered on an axis 15 and in which in turn is set a smaller inner element or disk 7 centered on an axis 16 offset from the axis 15. The elements 6 and 7 are both bodies of revolution, here circles, with frustoconical outer surfaces centered on the respective axes 15 and 16. The smaller disk 7 has a diameter equal to slightly less than the radius of the larger disk 6 and the axis 16 is spaced slightly more than one quarter of the diameter of the larger disk 6 from the large-disk axis 15. The disk 6 can rotate freely in the plate 5 about the axis 15 and the smaller disk 7 can rotate freely in the disk 6 about its axis 16.

The smaller disk 7 is formed offset from its axis 16 with a throughgoing hole 8 having a flared lower end 11. The upper face of the disk 7 is formed around the upper end of the hole 8 with a collar or nipple 9 that engages in the hole 10 of the lower plate 4. The plate 5 is formed with an upwardly open recess or cavity 12 of circular shape, centered on the axis 15, and of a diameter slightly less than that of the disk 6 so that the lower end 11 of the hole or passage 8 always opens into this cavity 12. The cavity 12 in turn is connected to the feed conduit 13 from the pump 17. It would also be within the scope of the invention to form the recess 12 in the lower face of the disk 6.

Figure 1:
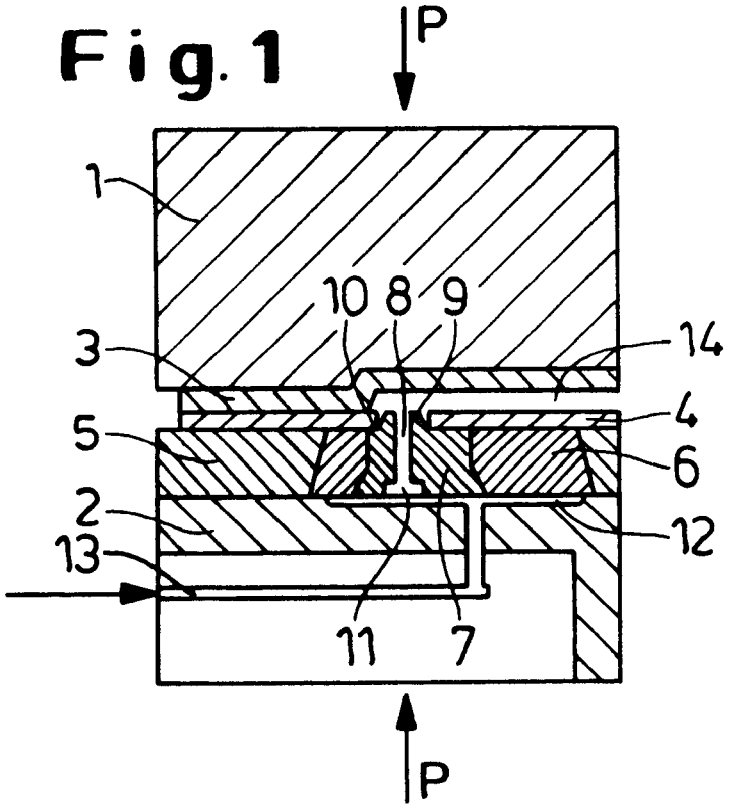
FIG. 1 is a section through a detail of a high-pressure shaping system according to the invention in the initial phases of the deformation operation.
Figure 2:
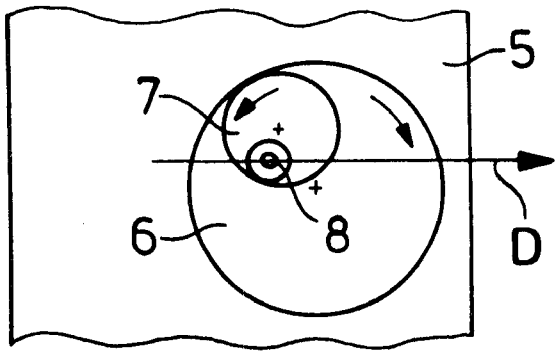
FIG. 2 is a top view of the bottom die half of FIG. 1.
Figure 3:
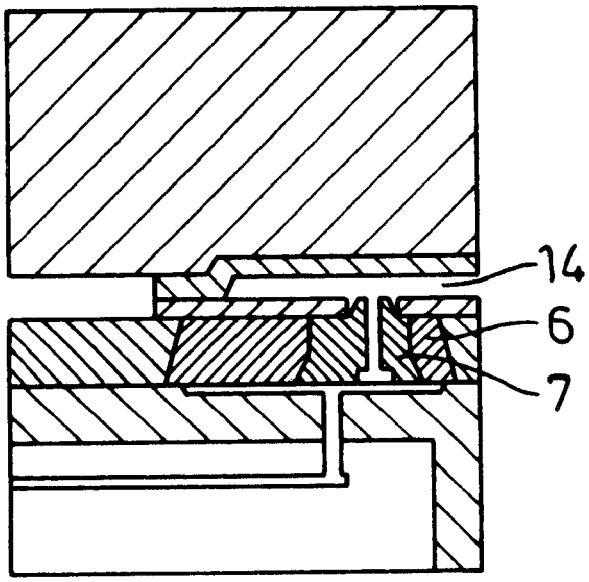
FIGS. 3 and 4 are views like respective FIGS. 1 and 2 at a later stage in the deformation operation.
Figure 4:
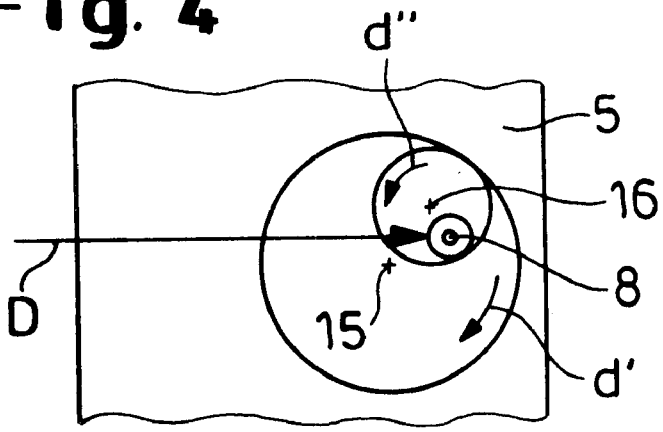

With this system after the two plates 3 and 4 are clamped as shown in FIG. 1 and the space 14 is pressurized, the plate edge having the hole 10 will creep inward as seen by a comparison of FIGS. 1 and 2 with FIGS. 3 and 4 in a straight line in direction D. This is the initial shaping stage during which the outer disk 6 will rotate in one direction d' and the inner disk in an opposite direction d" , allowing the hole 8 and nipple 9 to move in a perfectly straight line in direction D with the hole 10. Subsequently the force with which the die parts 1 and 2 are pressed together is normally increased substantially, as is the pressure applied through the conduit 13 and hole 10, to set this finished stage in a so-called calibrating phase.

Thus the hole 8 will remain perfectly aligned with the hole 10 during the entire deformation operation. The use of circular disks 6 and 7 makes sealing between them and between the disk 6 and the plate 5 relatively simple, while still allowing relatively easy pivoting about the axes 15 and 16.

We claim:

1. An apparatus for forming two plates into a hollow workpiece, the apparatus comprising:

a pair of dies together forming a cavity and having edge regions adapted to be pressed together in a direction against outer peripheries of the plates;

an outer element in the edge region of one of the dies adapted to rotate therein about an axis generally parallel to the direction;

an inner element set in the outer element and pivotal therein about an axis generally parallel to and offset from the outer-element axis, the inner element being formed offset from the respective inner-element axis with an axially throughgoing feed passage aligned with a feed hole in the plate engaging the one die; and means for forcing a fluid under pressure through the passage and hole into a space between the plates and thereby deforming the plates away from each other in the direction while displacing the hole perpendicular to the direction with rotation of the outer element in one sense and rotation of the inner element in an opposite sense for movement of the passage in a straight line perpendicular to the direction.

2. The forming apparatus defined in claim 1 wherein the two elements are disks of substantially circular shape.

3. The forming apparatus defined in claim 2 wherein the inner-element disk has a diameter equal to at most half a diameter of the outer-element disk.

4. The forming apparatus defined in claim 1 wherein the inner element has a face engageable with the one plate and formed around the passage with a collar engaging in the hole and fitting the inner element to the hole.

5. The forming apparatus defined in claim 1 wherein the inner element and the one plate have confronting faces, the means includes another passage formed in the one plate and opening at the one-plate face in alignment with the inner-element passage.

6. The forming apparatus defined in claim 5 wherein the one-plate face is formed with an enlarged recess into which the one-plate passage opens, the inner-element passage opening into the recess.

7. The forming apparatus defined in claim 6 wherein the recess is circular, generally centered on the outer-element axis, and of a diameter smaller than a diameter of the outer element.

8. The forming apparatus defined in claim 1 wherein the elements have frustoconical outer surfaces centered on the respective axes.

* * * * *